US005395262A

United States Patent [19]

Lwee

[11] Patent Number: 5,395,262

[45] Date of Patent: Mar. 7, 1995

[54] ELECTRICAL CONNECTOR

[75] Inventor: Nai H. Lwee, Fremont, Calif.

[73] Assignee: E. I. Du Pont de Nemours & Company, Wilmington, Del.

[21] Appl. No.: 255,826

[22] Filed: Jun. 8, 1994

Related U.S. Application Data

[63] Continuation of Ser. No. 187,830, Jan. 27, 1994, abandoned, which is a continuation of Ser. No. 109,144, Aug. 19, 1993, abandoned, which is a continuation of Ser. No. 910,063, Jul. 8, 1992, abandoned.

[30] Foreign Application Priority Data

Jan. 16, 1992 [JP] Japan ..... 4-001156 U

[51] Int. Cl.[6] ..... H01R 13/62

[52] U.S. Cl. ..... 439/326; 439/350

[58] Field of Search ..... 439/326-328, 439/636, 637, 350-358

[56] References Cited

U.S. PATENT DOCUMENTS

| | | | |
|---|---|---|---|
| 3,803,533 | 4/1974 | Taplin | 339/91 |
| 4,057,879 | 11/1977 | Eigenbrode | 24/230 R |
| 4,579,411 | 4/1986 | Cobaugh et al. | 339/75 MP |
| 4,713,013 | 12/1987 | Regnier et al. | 439/62 |
| 4,737,120 | 1/1988 | Grabbe et al. | 439/326 |
| 4,826,446 | 5/1989 | Juntwait | 439/326 |
| 4,850,891 | 7/1989 | Walkup et al. | 439/326 |
| 4,850,892 | 7/1989 | Clayton et al. | 439/326 |
| 4,986,765 | 1/1991 | Korsunsky et al. | 439/326 |
| 4,995,825 | 2/1991 | Korunsky et al. | 439/326 |
| 5,004,429 | 4/1991 | Yagi et al. | 439/326 |
| 5,013,257 | 5/1991 | Korsunsky et al. | 439/326 |
| 5,094,624 | 3/1992 | Bakke et al. | 439/326 |
| 5,123,857 | 6/1992 | Chao | 439/326 |
| 5,209,675 | 5/1993 | Korsunsky et al. | 439/326 |

*Primary Examiner*—David L. Pirlot

*Attorney, Agent, or Firm*—Woodcock Washburn Kurtz Mackiewicz & Norris

[57] ABSTRACT

An electrical connector is provided which can readily fix a metal latch member to a housing. A groove is provided in the housing of the connector to allow a daughter board to be inserted therein. A pair of resin latch members are provided one at each end of the groove to hold the daughter board in a predetermined latched position. A pair of metal latch members are provided one at each end of the housing to hold the daughter board in a sandwiched relation with the resin latch members interposed. The metal latch members are fixed to the housing by fitting their fixing section over the housing with openings of the fixing section fitted over the projections provided on the opposite side surface of the housing.

5 Claims, 8 Drawing Sheets

ELECTRICAL CONNECTOR

This is a continuation of application Ser. No. 187,830, filed Jan. 27, 1994, now abandoned, which is a continuation of application Ser. No. 109,144, filed Aug. 19, 1993, now abandoned, which is a continuation of application Ser. No. 910,063, filed Jul. 8,1992, now abandoned.

BACKGROUND OF THE INVENTION

1. Field of the Invention

The present invention relates to an electrical connector for connecting together first and second circuit boards.

2. Description of the Related Art

An electrical connector is known which electrically and mechanically connects together, for example, a memory control board called a "mother board" and a daughter board, such as a single-in-line memory module (SIMM).

U.S. Pat. No. 4,986,765 discloses an electrical connector having a resin housing on which a mother board is mounted and one pair of metal latch members for holding a daughter board in a sandwiched relation.

This daughter board mount surface of the housing has a slot for receiving the base end of the daughter board. Contact terminals are prodded in the slot to make electrical contact between the mother board and the daughter board. A pair of posts are formed integral with the housing such that the post is projected at each end of the slot. The post has a boss to be fitted in the corresponding opening of the daughter board.

Latch receiving members are projected on both ends of the daughter board mount surface with the pair of posts interposed. The latch receiving member is boxlike in configuration with the metal latch members received therein. The metal latch member is inserted in the latch receiving member and, by so doing, fixed to the housing.

The daughter board inserted into the slot is rotated at an area between the paired metal latch members. At this time, the paired latch members are pushed out, by the side edges of the daughter board, in a direction to allow the paired latch members to be elastically flexed away from each other. When the daughter board takes a predetermined attitude, the boss of the post is fitted in the associated opening and the paired latch members are elastically returned back to their initial states so that the daughter board is held in a sandwiched relation. By so doing, the daughter board is latched at a predetermined attitude.

In order to receive the latch member, it is necessary that the cross-sectional dimension of the latch receiving member be made greater than the transverse area between the latch members. Since such relatively great latch receiving member is projected at the housing, more resin material is needed due to a larger outer configuration of the housing. It is not easy to mold a housing of such a complex configuration. As a result, the electrical connector is complex to manufacture and high in manufacturing cost.

Further, it is cumbersome to incorporate the metal latch member in the box-like latch receiving member and it is proved noneffective to assemble the electrical connector. In order to set the metal latch members in place such that they are inserted in the latch receiving member, the internal configuration of the latch receiving member and associated external configuration of the metal latch member become complex.

SUMMARY OF THE INVENTION

It is accordingly the object of the present invention to provide an electrical connector which has a simpler, easier to manufacture and low cost housing and, even upon attachment and detachment of a second circuit board to and from a housing in repeated fashion, ensures high durability of paired metal latch members and enhances the reliability with which the second circuit board can be electrically connected to contact terminals and hence to a first circuit board.

According to the present invention, there is provided an electrical connector for connecting together first and second circuit boards, the electrical connector comprising:

an elongated housing one piece molded of an insulating resin material and having a first surface to which the first circuit board is to be attached and a second surface on which the second circuit board is to be attached, the second surface having one groove dimensioned to receive a base end portion of the second circuit board therein and a pair of resin latch members each extending from near each end of the groove and both supporting opposite side edges of the second circuit board from both sides in a manner to be maintained in a predetermined latched position;

a plurality of contact terminals, provided in the groove of the housing, for connecting together the first and second circuit boards; and a pair of metal latch members elastically holding the opposite side edges of the second circuit board from both sides in a sandwiched relation with the pair of resin latch members interposed, the metal latch member having a spring member placed in elastic contact with the resin latch member and a fitting member fitted over the end portion of the housing both in a direction in which the spring member extends and in a direction orthogonal to that in which the groove extends.

According to the embodiments of the present invention, the second circuit board has opening holes at those areas, each, near its end, and the resin latch member of the housing has engaging means for engaging the opening holes in the second circuit board.

Preferably, the fitting member of the metal latch member has openings and the housing, as projections each of which is fitted in the corresponding opening in the fitting member.

Preferably, the metal latch member has a reinforcing member for restricting any excessive flexing of the metal latch member.

Preferably, the metal latch member has a handle member for manually flexing the metal latch member.

According to the embodiment of the present invention, the metal latch member is formed of single metal sheet.

According to the embodiment of the present invention, the lower end portion of the metal latch member is fitted over the housing so that the metal latch member is fixed to the housing. Thus the housing obviates the necessity of providing a member for inserting the latch member and fixing it in place. This ensures a simplified form of electrical connector.

DETAILED DESCRIPTION OF THE PREFERRED EMBODIMENTS

Figure 1:
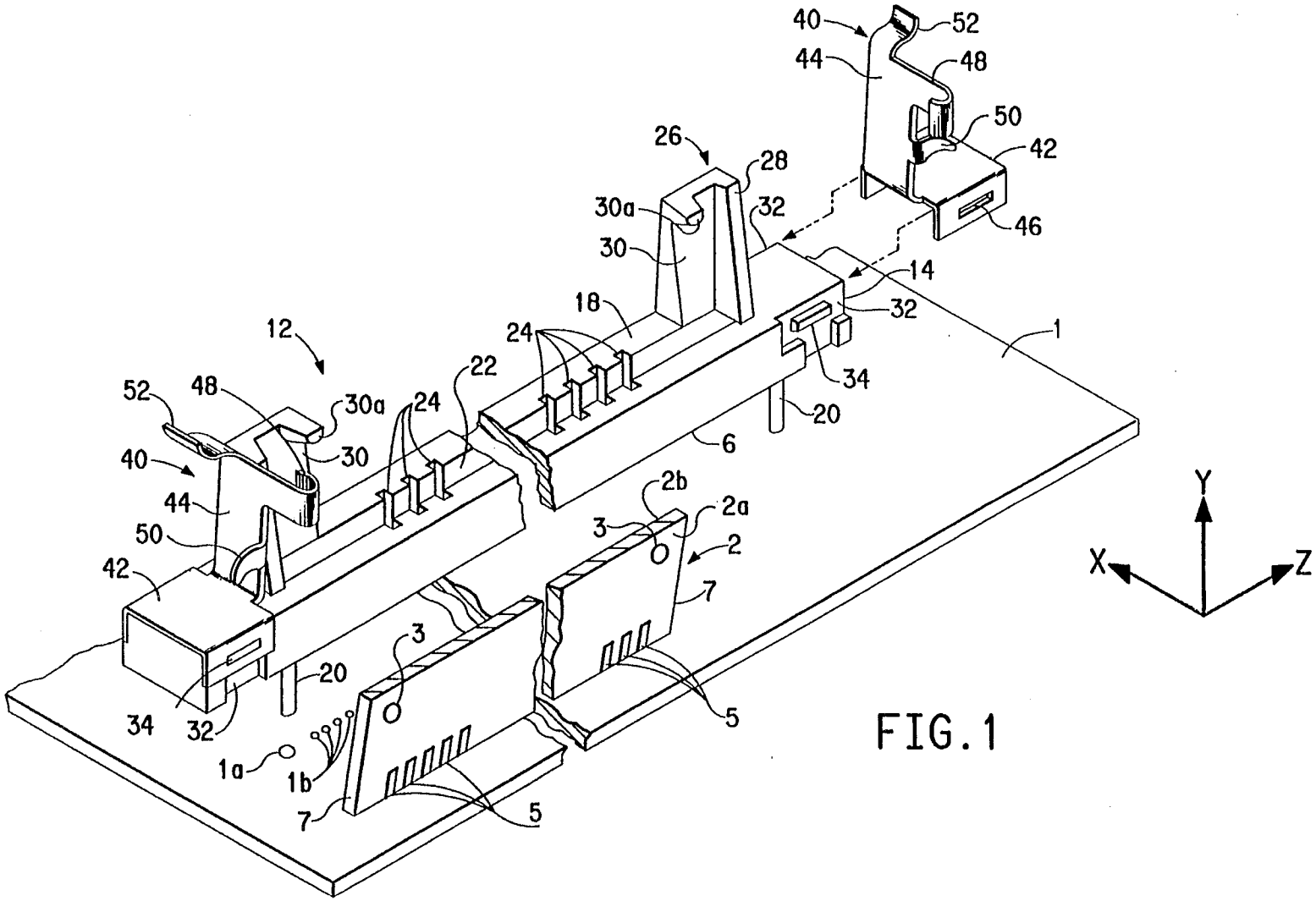
FIG. 1 is a perspective, partly exploded view showing an electrical connector according to an embodiment of the present invention.

FIG. 1 shows an electrical connector according to one embodiment of the present invention.

Figure 2:
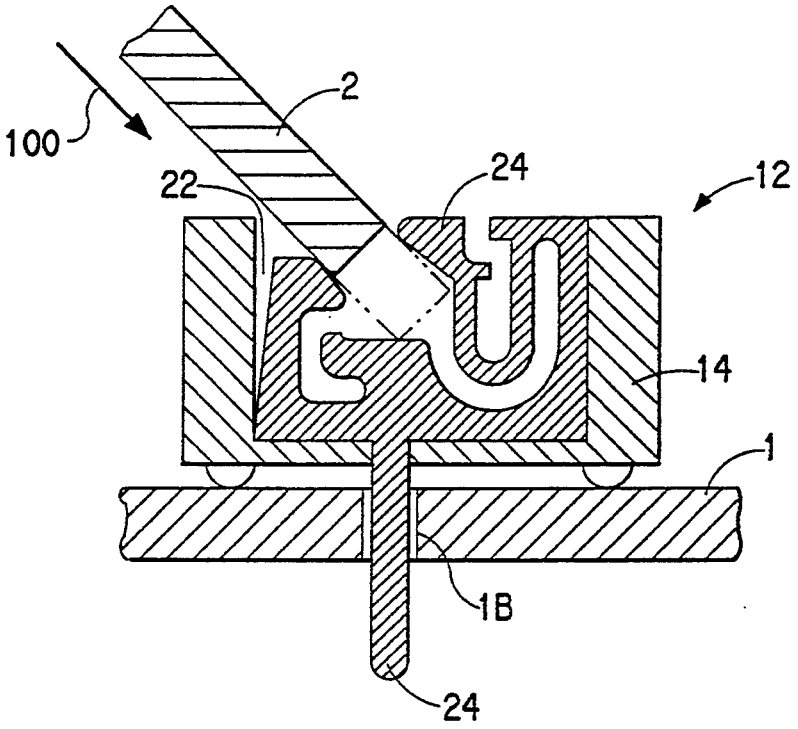
FIG. 2 is a cross-sectional view, taken along a Y direction in FIG. 1, showing a contact terminal in the housing.

The electrical connector 12 mechanically and electrically connects a mother board 1 to a daughter board 2. The mother board 1 is comprised of, for example, a memory control board. The daughter board 2 is comprised of, for example, a single-in-line memory module (SIMM) on which a memory chip, not shown, is mounted. The daughter board 2 has opening holes 3 on at each end portion in a width direction. A plurality of soldering pads 5 are arranged at a base end portion of the daughter board 2. In FIG. 1, 2*a* and 2*b* represent a major surface and rear surface, respectively.

The connector 12 has an elongated housing molded of an insulating resin material. In the following description let it be assumed that X, Y and Z directions denote the longitudinal direction of the housing and width direction of the daughter board 2, the transverse direction of the housing 14, and the height direction of the housing 14, respectively.

The housing has a lower surface 16 on which the mother board 1 is mounted and an upper surface 18 on which the daughter board 2 is mounted.

Legs 20 are provided on both end portion of a mother board mount surface 16 of the housing 14 in the X direction. The leg 20 is inserted through hole la in the mother board 1 and so fixed by soldering as to secure an electrical connection. By so doing, the connector is mounted on the mother board 1.

A slot or groove 22 is provided, along the X direction, in the daughter board mount surface 18 of the housing 14. A plurality of contact terminals 24 are arranged in the slot 22 along the X direction.

The contact terminals 24 can be arbitrarily selected from known elastic contact terminals for SIMM for example. It is possible to use that type of contact terminals 24 having a cross-sectional configuration as shown, for example in FIG. 2. The contact terminal 24 is electrically connected to the mother board 1 by an arbitrary method for, for example, inserting one end portion 24*a* thereof through the through hole 1*b* in the mother board 1.

Figure 3:
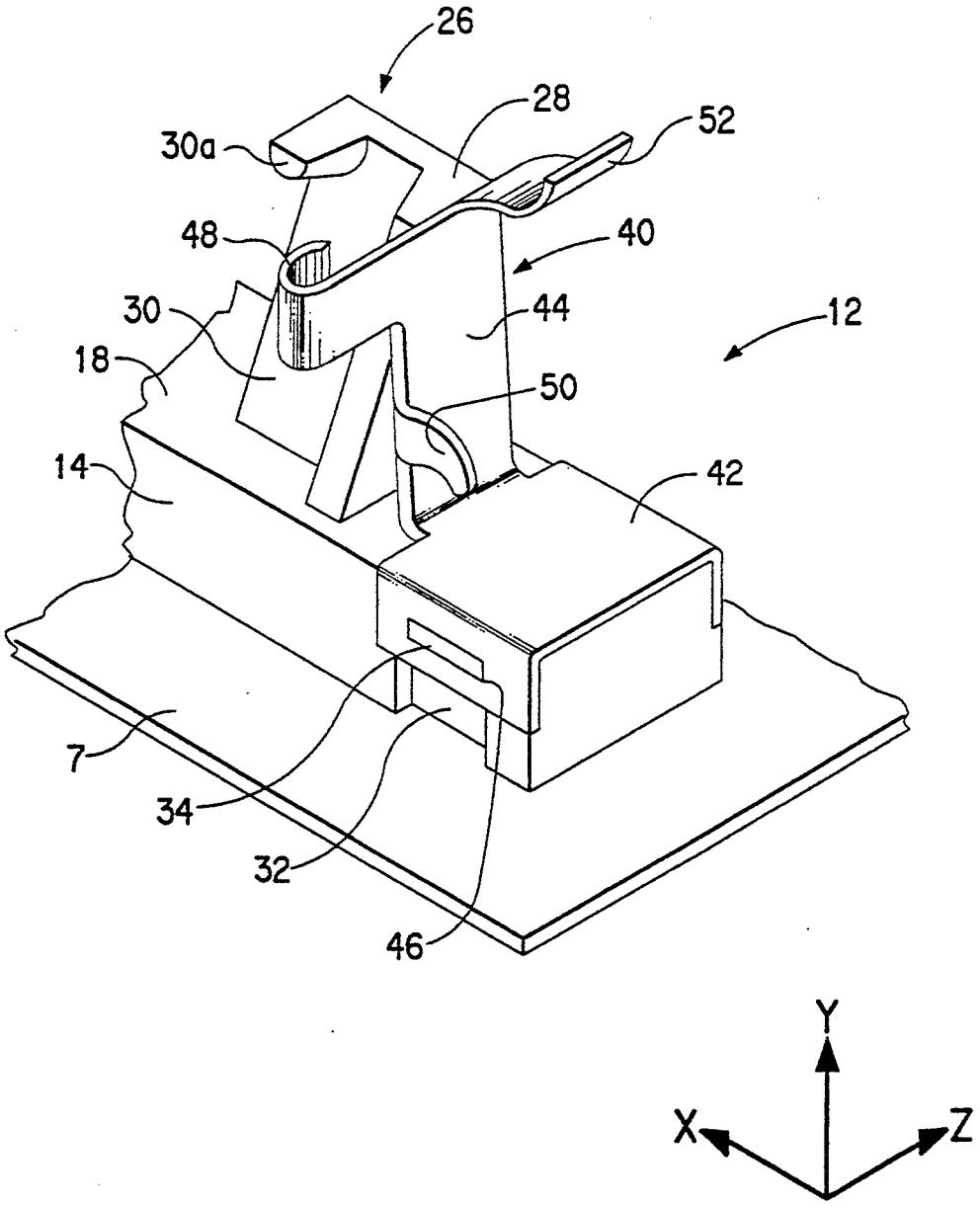
FIG. 3 is an enlarged, expanded view showing one end portion of the electrical connector in FIG. 2.
Figure 4:
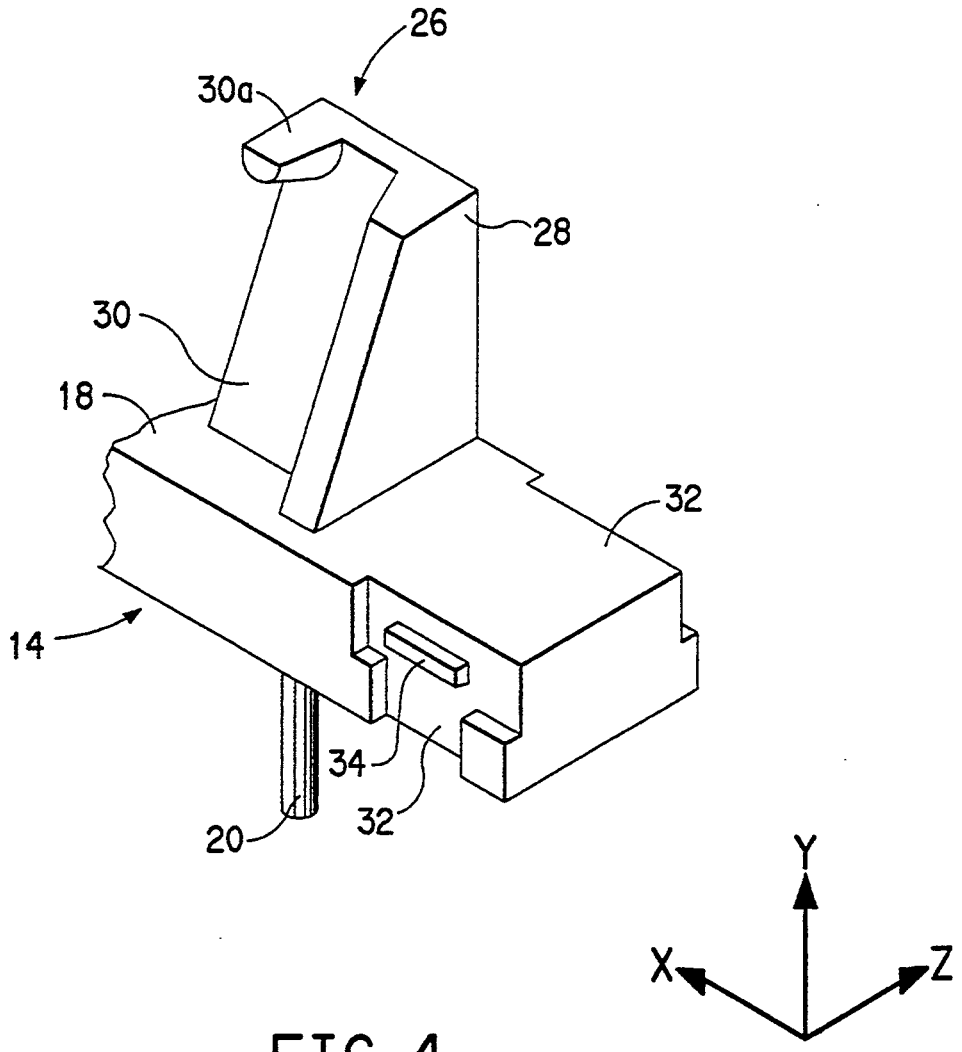
FIG. 4 is a perspective, partly expanded view showing one end portion of the housing before assembly.
Figure 6:
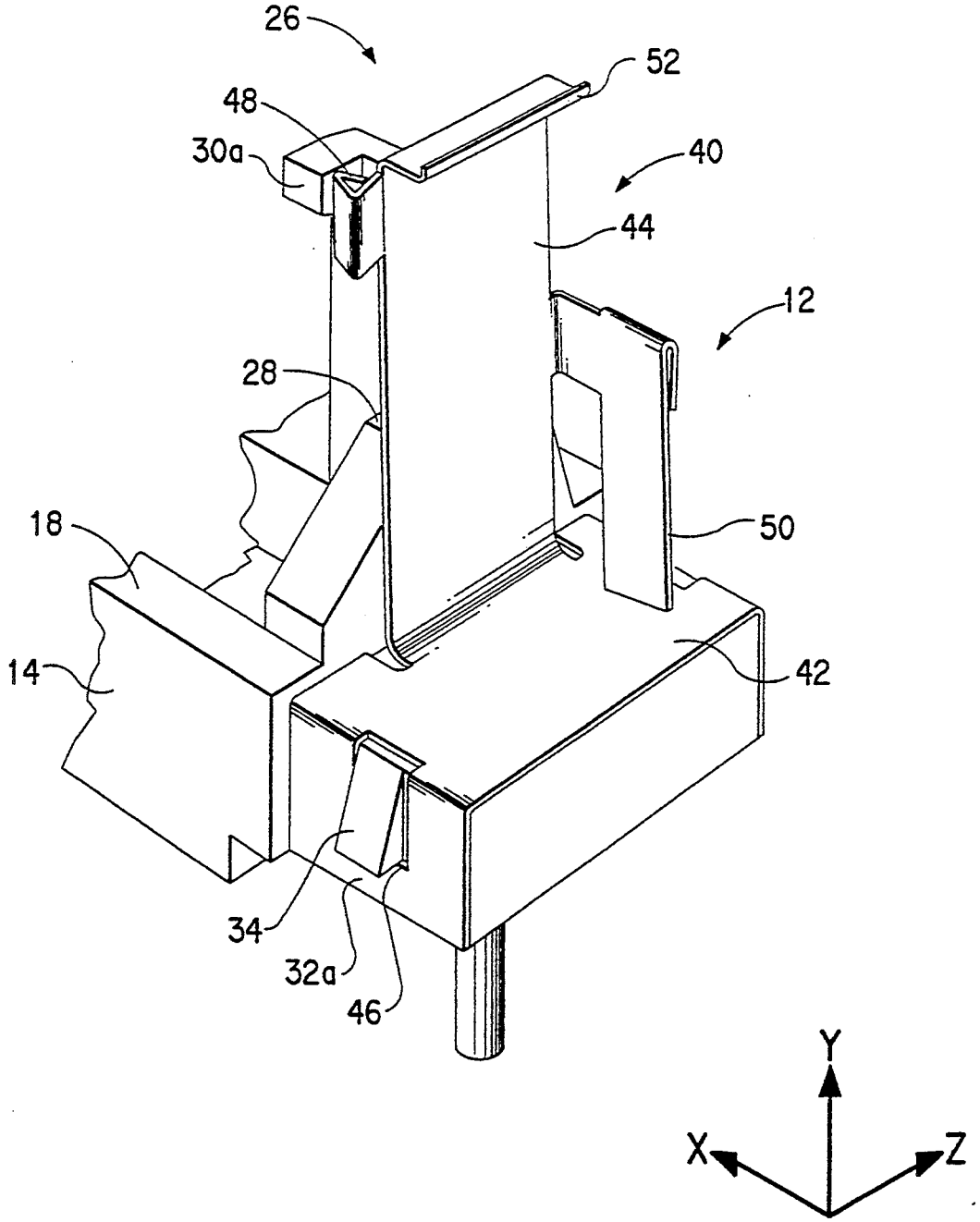
FIG. 6 is an enlarged, expanded view showing one end portion of an electrical connector according to a second embodiment of the present invention.
Figure 7:
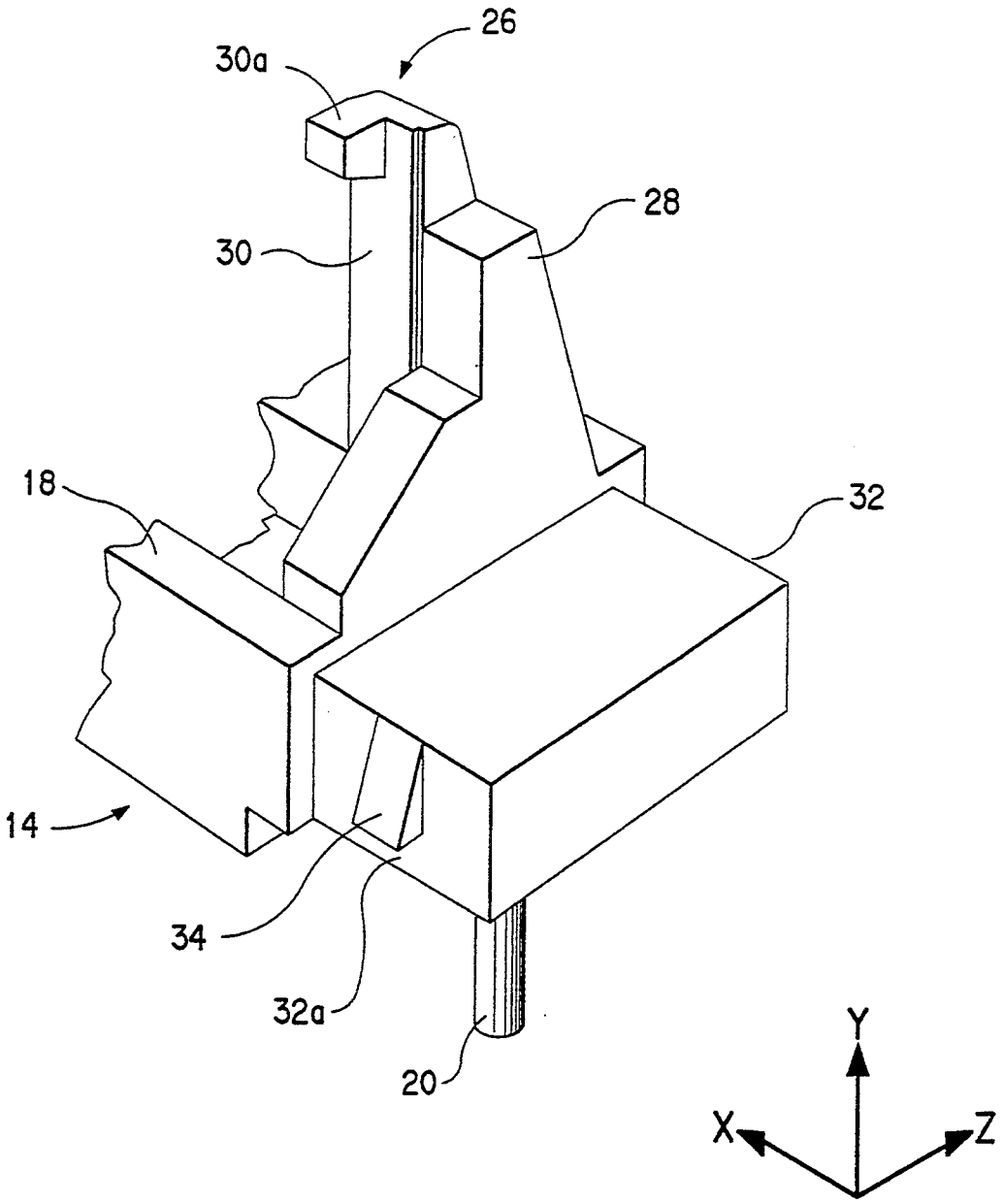
FIG. 7 is a perspective, partly expanded view showing one end portion of the housing in FIG. 6 before assembly.

As shown in FIGS. 3, 4, 6 and 7, in particular, latch members 26 made of a resin material are molded integral with the housing 14 such that they are located on at each end of the slot 22 in the daughter board mount surface 18. The resin latch member 26 comprises a wall-like latch 28 to be made in contact with a corresponding side edge 1 of the daughter board 2 as well as a post 30 with an upper boss 30*a*. The boss 30*a* engages the corresponding daughter board's opening hole 3 from the rear surface side of the daughter board 2. The latch 28 can be molded integral with the post 30 as shown in FIGS. 4 and 7 and a resultant integral structure is simpler and encounters no difficulty upon the molding of the housing 14.

Recesses 32 are provided in the side edge portions of both end portions of the daughter board amount surface 18 and extend along the X direction in the embodiment of FIGS. 3 and 4. The recess 32 is used to fit a metal latch member 40 over the housing 14 and fix it there as will be set out below. In order to achieve more positive fixing of the latch member 40 to the housing 14 it is preferred that a projection 34 be provided on each side surface of the housing at an area where the recess 32 is provided. The projections 34 are fitted into corresponding openings 46 in the latch member 40.

Alternatively, the side edges of the end portions of electrical connector 12 can be free of recesses as shown in FIGS. 6 and 7. A projection 34 is provided on each fiat side surface 32*a* of the housing 14. The projections 34 engage corresponding openings 46 in latch member 40 to affix the latch member 40 the housing 14.

The pair of metal latch members 40 are provided at each end portion of the housing 14 with the pair of resin latches 28 interposed. The metal latch members 40 are elastically deformable in the X direction and hold the opposite side edges 7 of the daughter board in a sandwiched relation in cooperation with the associated resin latches 28.

The distance between the paired resin latches 28 and that between the paired metal latches 40 are dimensioned to be made somewhat smaller than the width of the daughter board in the X direction. By so doing, these latches elastically hold the opposite sides 7 of the daughter board in that sandwiched relation.

Figure 5:
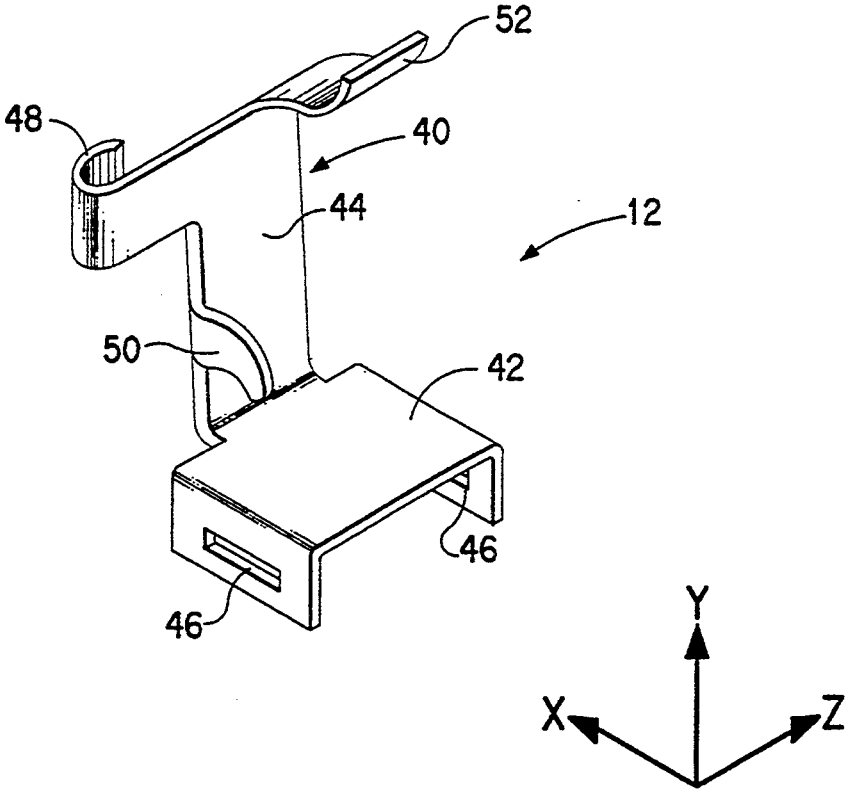
FIG. 5 is a perspective view showing a metal latch member.
Figure 8:
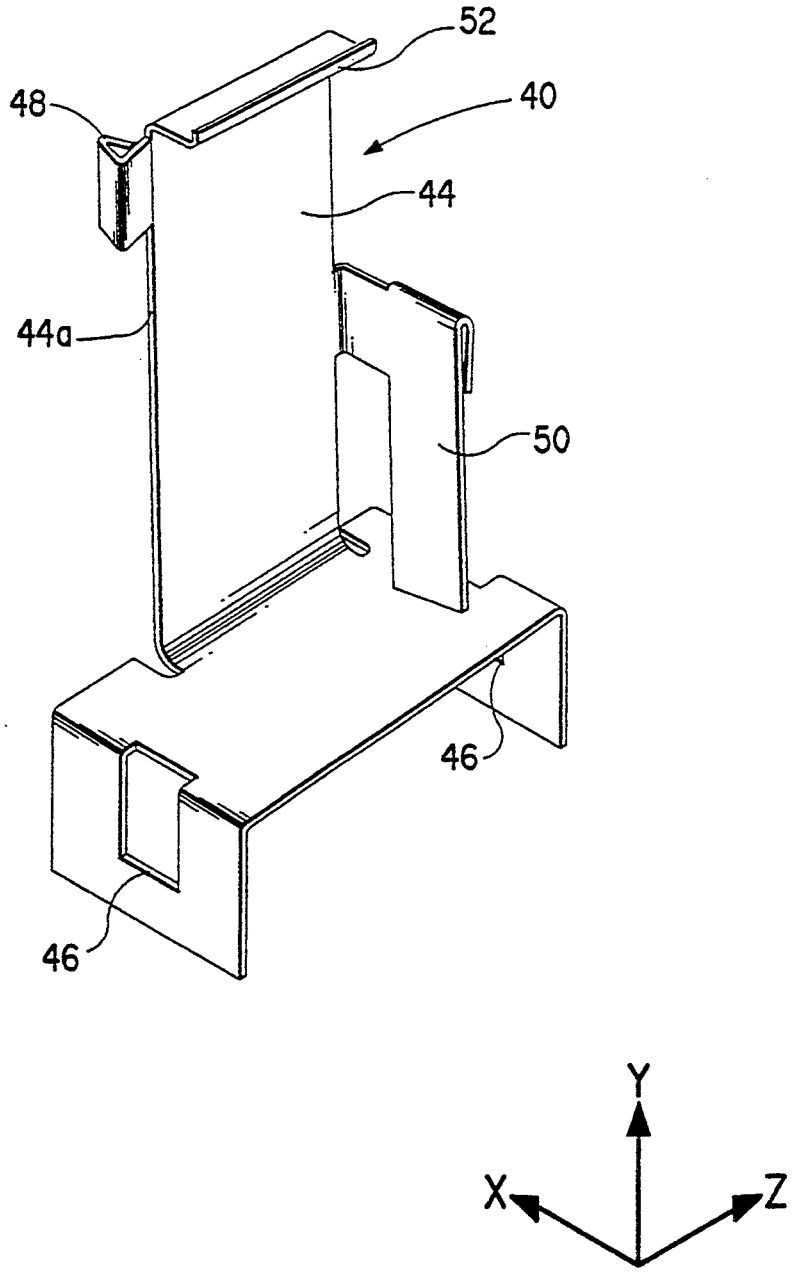
FIG. 8 is a perspective view showing the metal latch member of FIG. 6.

As shown in FIGS. 5 and 8 in particular, the metal latch member 40 is preferably stamped out of one metal sheet. As the metal sheet, use is made of an elastic one, such as phosphor bronze.

The metal latch member 40 has a fixing section 42 to be fitted over the housing 14 and a spring section or member 44 extending from the fixing section 42 and placed in elastic contact with the resin latch 28. The fixing section 42 of the metal latch member 40 is fitted in the recess 32, if one is present, in the housing 14 in a manner to cover the end portion of the daughter board mount surface 18 of the housing 14. It is preferable that a pair of openings 46 be provided in the fixing section 42 of the metal latch member 40 at those areas fitted over the associated projections on the housing.

A holding section 48 is provided on the upper end of one side edge 44*a* of the spring section 44 of the metal latch member 40 and extends such that it contacts the major surface 2*a* of the daughter board to provide an added holding power relative to the daughter board 2.

A regulating member 50 is preferably provided at one side edge 44*a* of the spring section 44 of the metal latch member 40 and extends such that it regulates any excessive flexing of the metal latch member 40. When the metal latch member 40 is flexed to some extent, that is, flexed in a direction to be moved away from each other, the forward end of the restricting member 50 is abutted against the latch member's fixing section 42 on the daughter board mount surface 18 and restricted from being further flexed. That is, the restricting member 50 serves as a stopper against any excessive load.

Such stopper can be molded of a resin material such that it is formed integral with the housing 14, but it may preferably be formed on the housing 14 from the standpoint of simplifying the shape of the housing 14. Forming the regulating section or member 50 on the metal latch member 40 can be more readily achieved than forming it by a stamping step.

A handle 52 is preferably provided on the upper end of the metal latch member 40 and extends such that it can be manually moved to flex the metal latch member 40 for attachment and detachment of the daughter board 2 to be made to and from the housing.

Upon the assembly of the electrical connector 12, the fixing section 42 of the metal latch member 40 is fitted over the housing 14 and the opening 46 of the latch members 40 engage the associated projections 34 of the housing 14 whereby the metal latch member 40 is fixed to the housing 14.

During assembly, the metal latch member 40 can be attached vertically to the housing 14. This is of important advantage to design an assembling apparatus for automatically assembling the electrical connector 12 and to effectively utilize a working space.

It is only necessary to provide the recesses 32 and projections 34 on the housing 14 in an attempt to firmly affix the metal latch member 40 the housing 14. These specific configurations allow the housing 14 to be made simpler and more compact than in the case where relatively large latch holding members are formed in the conventional counterpart. Thus it is possible to readily mold the housing 14 and to decrease the amount of resin material required.

Upon the attachment of the daughter board 2 to the electrical connector 12, the base end portion of the daughter board 2 is inserted into the slot 22 in an oblique direction (see FIG. 2) to the mother board 1. Then the daughter board 2 is rotated toward the resin latch member 26. During this rotation process, the paired resin latches 28 are pushed out by the side edges 7 of the daughter board so that the paired resin latches 28 and paired metal latch members 40 are elastically deformed in a direction to be moved away from each other.

When the base end of the daughter board 2 is seated on the contact terminals 24, the bosses 30*a* of the post 30 are fitted in the associated opening holes of the daughter board. At the same time, the paired resin latches 28 and paired metal latch members 40 are elastically returned back to their initial states. Here, the spring sections 44 of the paired metal latch members 40 elastically push out the paired resin latches 28 and hold the side edges 7 of the daughter board 2 in the sandwiched relation.

Upon the detachment of the daughter board 2 from the electrical connector 12, the paired metal latch members 40 are so expanded as to be moved away from each other. This can be readily done by operating the handle 52 provided with the metal latch members 40. This operation unlatches the daughter board 2 from the paired metal latch members 40. The unlatched daughter board 2 is vertically withdrawn freely clear of the electrical connector 12.

In the attach/detach cycles of the daughter board 2, any excessive flexing is restricted by the restricting member 50 upon the flexing of the metal latch members 40. As a result, the metal latch member 40 is prevented from being damaged, thus ensuring enhanced durability.

Although the embodiment of the present invention has been explained by way of example, the present invention is not restricted to that embodiment. Various changes or modifications of the present invention can be made within the spirit and scope of the present invention. For example, a feature of the present invention lies in that the metal latch member 40 can be fitted over the housing 14. The detailed configuration of the metal latch members 40 relative to the housing 14 is not restricted to those illustrated and explained above.

According to the electrical connector of the present invention, since the metal latch member is of such a type as to be fitted over the housing, it is not necessary to provide, relative to the housing, relatively large latch holding members which would be needed in the conventional electrical connector. This feature allows the housing to be made simpler in configuration and compact in size. In consequence, the housing is easier to mold and it is possible to reduce a resin material necessary for the molding of component parts involved. It is thus possible to more readily manufacture an electrical connector and to hence reduce the manufacturing costs.

What is claimed is:

1. An electrical connector for connecting together first and second circuit boards, which comprises:

an elongated housing one-piece molded of an insulating resin material and having a first surface to which the first circuit board is to be attached and a second surface on which the second circuit board is to be attached, the second surface having one groove dimensioned to receive a base end portion of the second circuit board therein and a pair of resin latch members each extending from near each end of the groove and both supporting opposite side edges of the second circuit board from both sides in a manner to be maintained in a predetermined latched position;

a plurality of contact terminals, provided in the groove of the housing, for connecting together the first and second circuit boards; and a pair of metal latch members elastically holding the opposite side edges of the second circuit board from both sides in a sandwiched relation with the pair of resin latch members interposed, the metal latch member having a spring member placed in elastic contact with the resin latch member and a fitting member fitted over the end portion of the housing, said member comprising a base section which extends parallel to the second surface of the housing and flanges which extend from the base section over the second surface toward the first surface and which have openings, the end portion of the housing having projections each of which is fitted in a corresponding opening in a flange.

2. The electrical connector according to claim 1, wherein the second circuit board has opening holes at those areas, each, near its end and the resin latch member of the housing has engaging means for engaging the opening holes in the second circuit board.

3. The electric connector according to claim 1, wherein the metal latch member has a restricting member for restricting any excessive flexing of the metal latch member.

4. The electrical connector according to claim 1, wherein the metal latch member has a handle member for manually flexing the metal latch member.

5. The electrical connector according to claim 1, wherein the metal latch member is formed of a single metal sheet.

* * * * *